US006003685A

United States Patent [19]

Malin

[11] Patent Number: 6,003,685

[45] Date of Patent: Dec. 21, 1999

[54] PEG BOARD HOOK AND SECURITY LOCK ASSEMBLY

[75] Inventor: Robert Malin, Menomonee Falls, Wis.

[73] Assignee: Frank Mayer & Associates, Inc., Grafton, Wis.

[21] Appl. No.: 09/191,510

[22] Filed: Nov. 13, 1998

Related U.S. Application Data

[60] Provisional application No. 60/065,568, Nov. 14, 1997.

[51] Int. Cl.[6] ..... E05B 73/00; B42F 7/00; F21L 15/08

[52] U.S. Cl. ..... 211/7; 211/59.1; 248/220.42; 70/62

[58] Field of Search ..... 211/7, 59.1, 4, 211/57.1, 106; 248/220.31, 220.41–220.43; 70/46, 61, 62, 1, 38 R

[56] References Cited

U.S. PATENT DOCUMENTS

| | | | |
|---|---|---|---|
| 153,673 | 8/1874 | Fox | 70/62 |
| 3,409,260 | 11/1968 | Bleed | 248/216 |
| 3,472,385 | 10/1969 | Shapiro et al. | 211/7 |
| 3,483,995 | 12/1969 | Larson | 248/220.41 |
| 3,516,719 | 6/1970 | Weisblat | 211/7 |
| 3,545,711 | 12/1970 | Scheneman | 248/220.43 |
| 3,677,415 | 7/1972 | Radek | 248/220.31 |
| 3,827,569 | 8/1974 | Canning | 248/220.42 |
| 3,964,712 | 6/1976 | Staudte, Jr. | 248/223 |
| 3,985,324 | 10/1976 | Larson | 248/223 |
| 4,308,961 | 1/1982 | Kunce | 211/94.5 |
| 4,351,440 | 9/1982 | Thalenfeld | 211/57.1 |
| 4,441,619 | 4/1984 | Gibitz | 211/60 T |
| 4,506,856 | 3/1985 | Rich et al. | 248/220.31 |
| 5,027,622 | 7/1991 | Hatch et al. | 70/14 |
| 5,082,215 | 1/1992 | Hutchison | 211/59.1 |
| 5,123,189 | 6/1992 | Fast et al. | 211/59.1 |
| 5,231,779 | 8/1993 | Valiulis et al. | 211/59.1 |
| 5,236,163 | 8/1993 | Valiulis | 211/59.1 |
| 5,259,220 | 11/1993 | Fredrickson | 70/14 |
| 5,275,027 | 1/1994 | Eklof et al. | 211/4 |
| 5,348,167 | 9/1994 | Jensen | 211/59.1 |
| 5,379,976 | 1/1995 | DeGirolamo | 248/220.43 |
| 5,429,334 | 7/1995 | Hutchison | 211/59.1 |
| 5,676,258 | 10/1997 | Leyden et al. | 211/7 |
| 5,689,978 | 11/1997 | Eklof et al. | 70/62 |

*Primary Examiner*—Daniel P. Stodola
*Assistant Examiner*—Jennifer E. Novosad
*Attorney, Agent, or Firm*—Nilles & Nilles, S.C.; James F. Boyle

[57] ABSTRACT

A peg board hook and security lock assembly for displaying merchandise includes a vertical mounting plate having on its upper edge a first hook portion for suspending the device from a first opening in a peg board, and a backer plate having a second hook portion, the backer plate being fastened to the vertical mounting plate for securing the lower portion of the mounting plate to a second opening in the peg board. A cantilevered post extending outwardly from the mounting plate and including on its distal end a notched surface, and a locking mechanism selectively engageable with the notched surface, provides a point-of-purchase device for displaying merchandise in a reasonably secure manner so as to prevent shoplifting of the merchandise on display.

7 Claims, 3 Drawinsg Sheets

PEG BOARD HOOK AND SECURITY LOCK ASSEMBLY

RELATED APPLICATIONS

The present application claims priority based on a provisional application, Ser. No. 60/065,568, filed under the same title on Nov. 14, 1997.

BACKGROUND OF THE INVENTION

Field of the Invention

The present invention relates to a peg board hook and security lock assembly for displaying items of merchandise in a retail area.

BACKGROUND OF THE RELATED ART

Retailers must naturally display the items that they are offering for sale so that purchasers have an opportunity to see what it is they are buying. However, in doing so, the retailer must be cognizant of the risk of shoplifting. This is especially true for items such as calculators, watches, video games, small electronic appliances, and other items of substantial value which if left unprotected they would be enticing targets for potential shoplifters.

On the one hand, it is highly desirable to display the merchandise in a manner so that the purchaser can not only see the item but also touch it and if necessary sort through a selection of items so that the purchaser can choose the particular item that he or she wants to buy. Merchandise stored in a back room or even when displayed in a locked glass cabinet is simply too inaccessible. Merchandise normally sells better when shoppers are able to both see and touch and thereby interact with the items they are considering buying.

On the other hand, merchandise of significant value should not be so freely accessible that it can be easily stolen. It is simply not possible to watch all customers all the time, and even if one could, surveillance alone is not always a sufficient deterrent to theft.

Retailers commonly use what is known as a peg board for displaying merchandise. A peg board is a vertical panel having a regular pattern of holes in it. The holes in the peg board are used for suspending hooks for hanging the merchandise for display. A number of peg board hooks are known in the art, some of which incorporate a locking mechanism of one type or another, such as those disclosed for example in U.S. Pat. No. 3,409,260 issued to T. M. Bleed for a Hanger for Perforated Panels, U.S. Pat. No. 3,472,385 issued to L. L. Shapiro et al. for a Hanger Bar Lock, U.S. Pat. No. 3,964,712 issued to Walter J. Staudte, Jr. for an Apertured Panel Bracket, U.S. Pat. No. 3,985,324 issued to Charles O. Larson for a Tool Holder for Pegboard, U.S. Pat. No. 4,308,961 issued to Thomas M. Kunce for an Article Supporting Structure, U.S. Pat. No. 4,351,440 issued to David R. Thalenfeld for a Merchandise Hook, U.S. Pat. No. 4,441,619 issued to Ernest L. Gibitz for a Tool Holder Combination, U.S. Pat. No. 5,027,622 issued to J. Mel Hatch for a Locking Device for Rods Extending from Merchandizing Displays, U.S. Pat. No. 5,259,220 issued to Howard J. Fredrickson for a Security Device for Merchandise Display Hooks, U.S. Pat. No. 5,676,258 issued to Roger J. Leyden for a Security System for Apertured Goods, and U.S. Pat. No. 5,689,978 issued to Thomas Elwood Eklof et al. for a Security Lock for Merchandise Display Hooks.

The devices disclosed above either provide no security at all, or in those that do the locking mechanism is either too elaborate or too costly to manufacture. Perfect security is not required. However, an improved peg board hook which permits personal contact with the merchandise being offered for sale, yet displays the merchandise in a manner which greatly inhibits and in many instances indeed prevents theft, and yet is also cost effective to manufacture and easy for store personnel to use, is desired.

SUMMARY OF THE INVENTION

A peg board hook and security lock assembly is disclosed. The present invention is specifically designed for use displaying merchandise on a peg board of the type commonly used in retail stores in a manner which permits shoppers to see and touch the items yet also provides a substantial deterrent to shoplifting. The present invention includes a means for securely fastening the hook to the peg board so that it may not be removed without the use of a specialized tool, and also a means for securely hanging the merchandise on the hook so that the items may not be removed from the display hook by unauthorized personnel.

The primary components in the invention include a novel mounting bracket for securely mounting the hook to at least two holes in a perforated peg board, a cantilevered locking bar for hanging merchandise thereon for display, and a locking mechanism on the end of the bar. Additional features of the primary components of the invention are described in detail below.

Accordingly, it is a primary object of the invention to provide a cost effective, easy to use, yet secure peg board hook for displaying merchandise in a retail area. Other objects and advantages of the invention will become apparent from the following description which, together with the accompanying drawings, sets forth by way of illustration and example certain embodiments of this invention.

BRIEF DESCRIPTION OF THE DRAWINGS

The drawings, which constitute part of this specification, and include exemplary embodiments of the present invention, include the following.

DETAILED DESCRIPTION OF THE INVENTION

Figure 1:
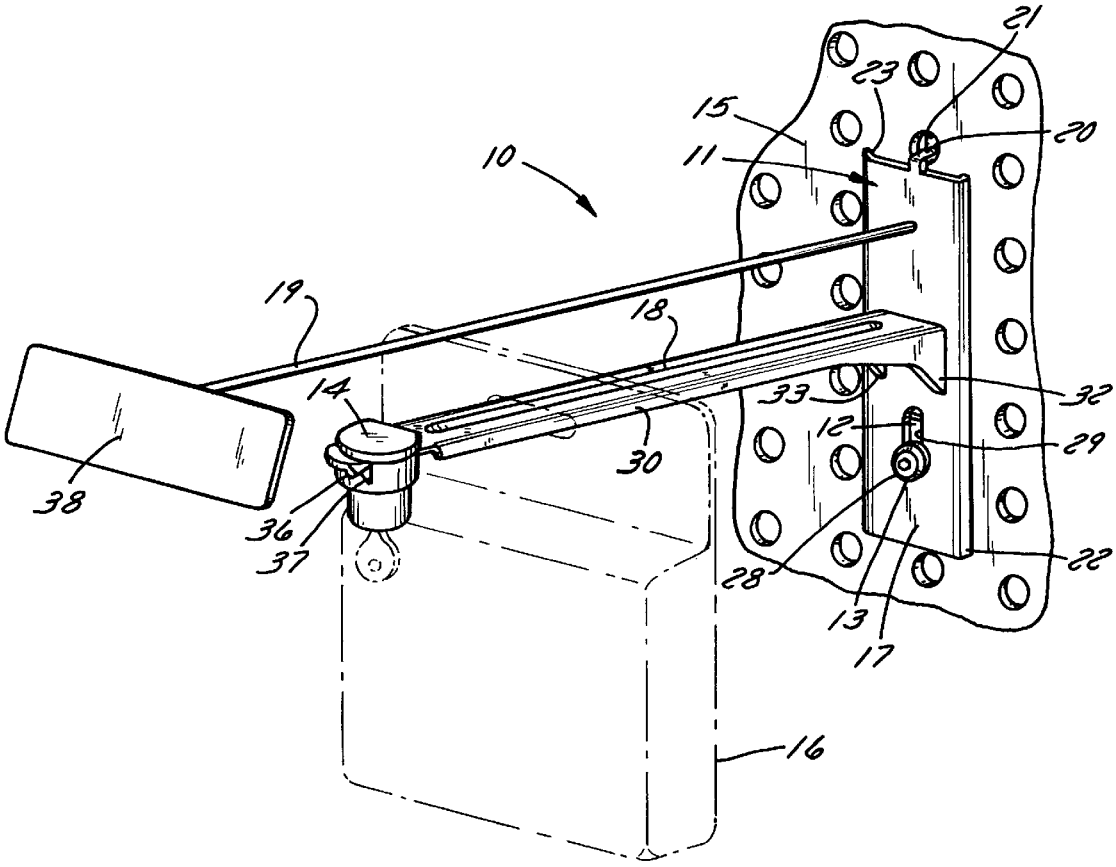
FIG. 1 is perspective view of the present invention of a secure peg board hook.
Figure 2:
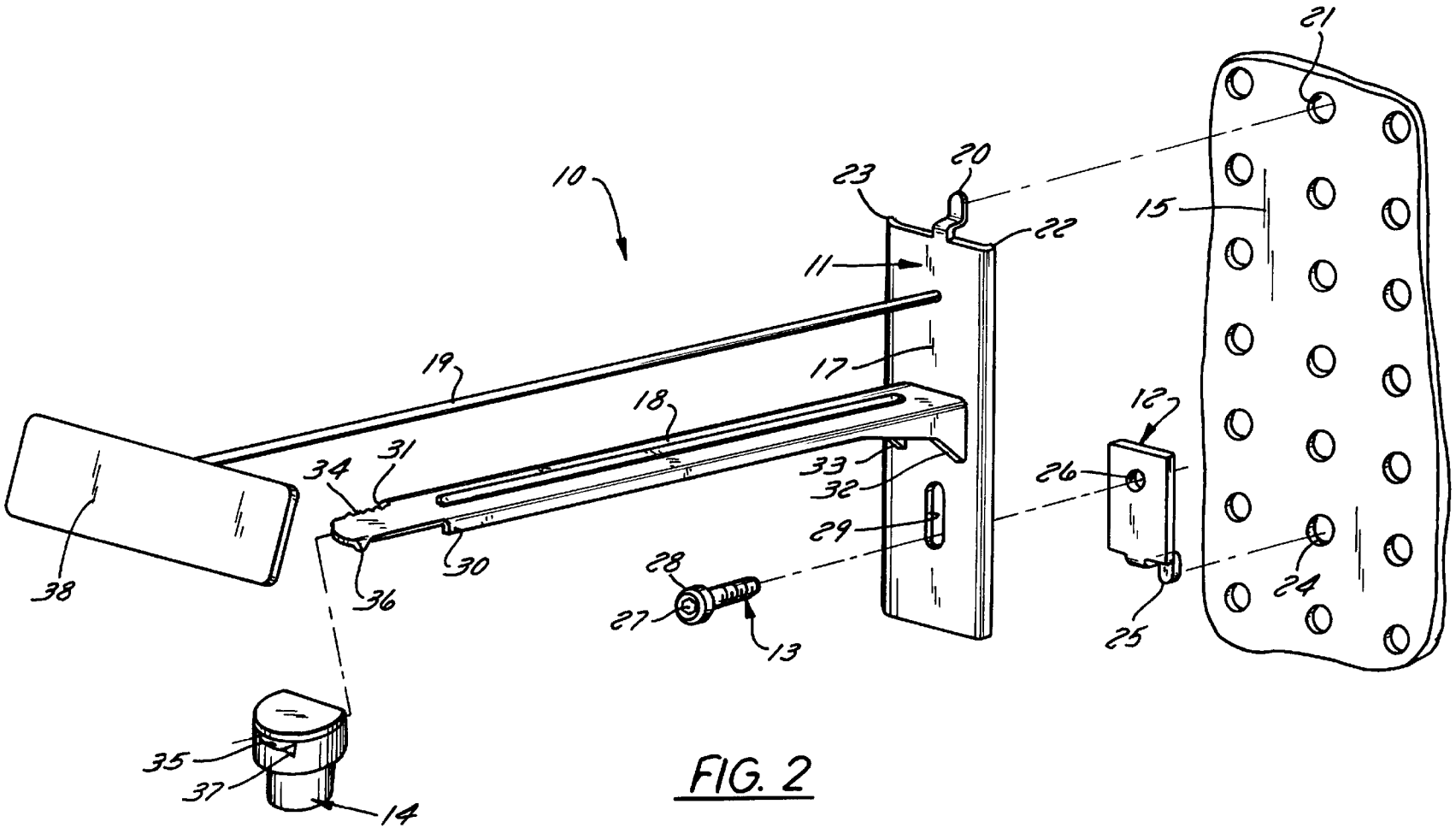
FIG. 2 is an exploded perspective view of the secure peg board hook.
Figure 3:
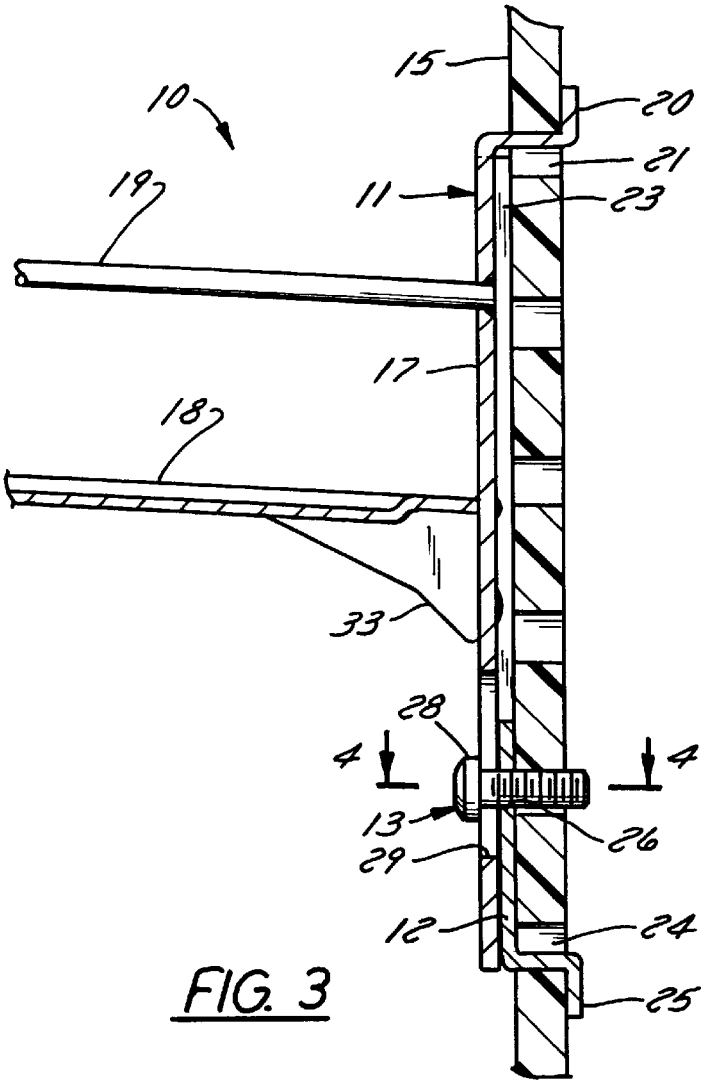
FIG. 3 is a sectional side view of the secure peg board hook.
Figure 4:
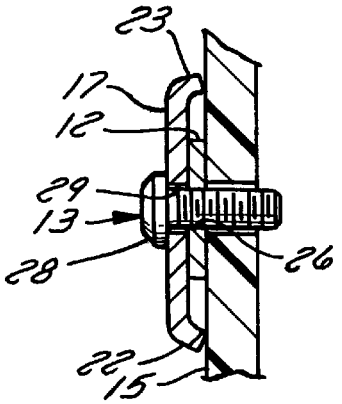
FIG. 4 is a sectional top view of the secure peg board hook, as viewed from line 4—4 of FIG. 3.

With reference to FIGS. 1–4, the present invention of a merchandise display unit 10, and in particular a secure peg board hook, is comprised essentially of a means for mounting the display unit on a peg board, means for hanging or suspending articles on the display unit, and a means for locking or otherwise securing the merchandise articles on the display unit. With specific reference to FIG. 2, the hardware components of the invention include a security bracket 11, a small peg board backer plate 12, a security type fastener 13, and a lock 14.

As mentioned, the present invention is specifically adapted for use on a peg board 15 of the type commonly used in retail stores. To be more specific, a peg board 15 is an apertured panel, oriented vertically, and has a regular pattern of holes or openings in the panel. Specialized hooks are inserted into the holes on the peg board, and from the hooks various items of merchandise 16 can be suspended for display in the retail store. The present invention may of course be used in a wide range of environments, but it is specifically designed as a point-of-purchase device for selling merchandise.

The security bracket 11 is preferably comprised of a vertical mounting plate 17, a first cantilevered post 18, and a second cantilevered post 19. The vertical mounting plate 17 is a somewhat elongated, substantially rectangular metal plate having on its upper edge an upwardly directed hook 20 for insertion into and engagement with a first opening 21 in the peg board 15. The vertical mounting plate 17 may also optionally include rearwardly turned side edges 22 and 23, which increases the structural stiffness of the plate. The rearwardly turned side edges also effectively create a thin space between the back side of the mounting plate 17 and the surface of the peg board 15 for placement of the small peg board backer plate 12, which is discussed further below. The vertical mounting plate 17 further includes a means for fastening a lower portion of the plate to a second opening 24 in the peg board 15, the second opening 24 being preferably oriented directed below the first opening 21 in the peg board 15 through which the upper hook 20 is placed.

The means for fastening the lower portion of the vertical plate is preferably comprised of the small peg board backer plate 12 and the security type fastener 13. The small peg board backer plate 12, which may also be referred to as a second vertical plate, is fastenable to the back side of the vertical mounting plate 17 such that the small peg board backer plate 12 is sandwiched between the back side of the vertical mounting plate 17 and the surface of the peg board 15. The small peg board backer plate 12 has on its lower edge a downwardly turned hook 25 for insertion into and engagement with the second opening 24 in the peg board 15. The small peg board backer plate 12 further includes a threaded hole 26, preferably in the central or upper central portion of the backer plate 12 so that, when the backer plate is assembled to the mounting plate, the threaded hole on the backer plate is in alignment with a corresponding hole or slot (which is not threaded) on the mounting plate. A threaded fastener is used to fasten the peg board backer plate 12 to the back side of the vertical mounting plate 17 in a manner such that the upward projecting hook 20 on the vertical mounting plate 17 and the downwardly projecting hook 25 on the peg board backer plate 12 are securely held in place within the first and second openings on the peg board 21 and 24, respectively. The fastener 13 for fastening the peg board backer plate 12 to the vertical mounting plate 17 is preferably a security type fastener, meaning that there is an irregular impression 27 in the head 28 of the fastener which requires the use of a specialized tool to tighten and moreover to loosen and remove the fastener. Examples of such security type fasteners may include a hex socket or torx socket screw which of course requires the use of a complementary Allen wrench or torx wrench as the case may be. However, a special security type fastener is not especially critical to achieve the primary object of the invention. Even a standard straight or Phillips type fastener would nonetheless require the use of a tool to remove the security bracket from the peg board.

Alternatively, the means for securing the lower portion of the vertical mounting plate 17 may be accomplished by use of a fastener to fasten the lower portion of the vertical plate to the peg board, and also using a wall anchor for anchoring the fastener within the second opening in the peg board. A security type fastener is again most preferable, although as mentioned even a traditional straight or Phillips type fastener would nonetheless require the use of a tool to disassemble the security bracket from the peg board. Regardless of whether a backer plate or a fastener/anchor combination is used to secure the lower portion of the mounting plate to the peg board, the fastener is preferably though not necessarily inserted through a relatively short vertical slot 29 in the vertical mounting plate so that the merchandise display of the present invention may be used on different types of peg boards which have different spacing dimensions in the pattern of holes or openings in the peg board.

The first cantilevered post 18 extends horizontally and outwardly from approximately the central portion of the vertical mounting plate 17. The first cantilevered post 18 should be structurally strong enough to hold at least several pounds of merchandise. Accordingly, the first cantilevered post 18 is preferably constructed from an elongated metal plate having downward turned side edges 30 and 31, and downwardly angled side portions 32 and 33 for welding or otherwise attaching the first cantilevered post to the mounting plate 17 and supporting it in a substantially vertical position. On the distal end of the first cantilevered post, i.e., on the end opposite of where the vertical mounting plate is attached, are a series of notches 34 formed by V-shaped depressions or indentations in one side edge of the metal plate.

The lock 14 has a slotted opening 35 corresponding to and slidable over the substantially flat distal end of the metal plate. The lock 14 preferably includes a locking mechanism which is engageable with the notches 34 in only one direction. To that end, the security bracket 11 and lock 14 each preferably include means which, when used in combination, permit the assembly of the lock 14 onto the security bracket 11 in only one direction. This may be accomplished by having on the extreme end of the first cantilevered post 18, on the side portion opposite the notches 34, a downward turned corner 36, and the slotted opening 35 in the lock 14 having an expanded space 37 corresponding to the downward turned corner 36 so that the lock 14 is slidable onto the first cantilevered post 18 in only one direction. This prevents the store employee from placing the lock on backwards, in which case it could be simply pulled off by anyone.

The security bracket 11 also preferably includes a second cantilevered post 19, above and substantially parallel to the first cantilevered post 18, which also extends outwardly from the vertical mounting plate 17. The second cantilevered post 19 has a small graphics plate 38 attached onto the end of it for displaying graphic information about the merchandise 16 on display, such as the brand name, model and price. For most merchandise items it is unlikely that the second cantilevered post will be used for anything other than displaying graphic information about the merchandise on display, and so it is sufficient to construct the second cantilevered post from a common metal bar tack welded or otherwise affixed onto the upper portion of the vertical mounting post.

Of course, the structural and functional details of the present invention described herein are not to be interpreted as limiting the scope of the invention, but are provided merely as a basis for the claims and for teaching one skilled in the art to various employ the present invention in any appropriately detailed manner. Changes may be made in the details of construction, arrangement or use of the invention without departing from the spirit of the invention, especially as defined in the following claims.

I claim:

1. A merchandising display for suspending articles on a peg board, said peg board comprising a vertical panel having a regular pattern of openings therein, said merchandise display comprising:

a vertical mounting plate, said vertical mounting plate having on its upper edge an upwardly directed hook for engaging a first opening in said peg board;

means for fastening a lower portion of said vertical mounting plate to a second opening in said peg board;

a first cantilevered post extending horizontally outwards from said vertical mounting plate for suspending said articles therefrom, said first cantilevered post having on its distal end a plurality of notches on one side and a downwardly turned corner on a side opposite of the notches; and a portable lock slidable onto the distal end of said first cantilevered post, said lock having a slotted opening including an expanded space corresponding to said downwardly turned corner for sliding said lock onto the distal end of the first cantilevered post in only one direction and thereby engaging said lock with said notches.

2. The merchandise display of claim 1, wherein the first cantilevered post is comprised of an elongated metal plate having downwardly turned side edges.

3. The merchandise display of claim 2, further comprising a second cantilevered post above and substantially parallel to the first cantilevered post, said second cantilevered post also extending outwardly from the vertical mounting plate and having a surface on its distal end for displaying graphic information about the articles on display.

4. The merchandise display of claim 3, wherein the second cantilevered post comprises an elongated metal bar.

5. The merchandise display of claim 4, wherein the second cantilevered post further comprises on its distal end a display plate for placing thereon graphic information about the articles on display.

6. The merchandise display of claim 2, wherein the notches are comprised of V-shaped depressions in one side edge of the distal end of said first cantilevered post.

7. The merchandise display of claim 1, wherein the means for fastening the lower portion of the vertical mounting plate to the second opening in the peg board comprises a vertical backer plate fastened between a back side of the vertical mounting plate and an outwardly exposed vertical surface of the peg board, said vertical backer plate having on its lower edge a downwardly turned hook for engaging the second opening in the peg board, and said vertical backer plate further having a threaded opening therein, and the display further comprising a threaded fastener engageable with the threaded opening for fastening the vertical backer plate to the vertical mounting plate.

* * * * *